US007223113B2

(12) United States Patent
Nakamura

(10) Patent No.: US 7,223,113 B2
(45) Date of Patent: May 29, 2007

(54) CONNECTOR AND A CONNECTOR ASSEMBLY

(75) Inventor: Hideto Nakamura, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/498,337

(22) Filed: Aug. 3, 2006

(65) Prior Publication Data

US 2007/0054536 A1 Mar. 8, 2007

(30) Foreign Application Priority Data

Aug. 17, 2005 (JP) ..... 2005-236593

(51) Int. Cl.
*H01R 13/627* (2006.01)

(52) U.S. Cl. ..... 439/353

(58) Field of Classification Search ..... 439/353, 439/352, 382, 354, 357–358, 489, 595, 378, 439/350

See application file for complete search history.

(56) References Cited

U.S. PATENT DOCUMENTS 5,314,345 A 5/1994 Cahaly et al.
6,527,579 B2 * 3/2003 Sato et al. ..... 439/382
6,663,397 B1 * 12/2003 Lin et al. ..... 439/63
6,976,875 B2 * 12/2005 Nishide ..... 439/598
7,025,636 B2 * 4/2006 Allen ..... 439/638

* cited by examiner

*Primary Examiner*—J. F. Duverne
(74) *Attorney, Agent, or Firm*—Gerald E. Hespos; Anthony J. Casella

(57) ABSTRACT

A first housing (10) is formed with guiding holes (24) through which a releasing member (26) is inserted while being held in contact therewith in a movable range between a standby area and a releasing position. In the process of connecting the first housing (10) and a second housing (40), the resilient pieces (18) come into engagement with the second housing (40) to be resiliently deformed, thereby releasing an interlocked state of the resilient pieces (18) and locking pieces (29), while the locking pieces (29) are not in contact with the second housing (40). Since the first housing (10) is formed with the guiding holes (24) through which the releasing member (26) is inserted while being held in contact therewith, the releasing member (26) is smoothly moved without being displaced and being forced.

18 Claims, 13 Drawing Sheets

CONNECTOR AND A CONNECTOR ASSEMBLY

BACKGROUND OF THE INVENTION

1. Field of the Invention

The invention relates to a connector and to a connector assembly.

2. Description of the Related Art

U.S. Pat. No. 5,314,345 discloses a connector with first and second housings. A releasing member is provided in the first housing and is movable between a releasing position and a standby area located behind the releasing position. A shorting terminal is provided in the second housing for shorting terminal fittings. A resilient piece is provided in the first housing and engages a locking piece on the releasing member to hold the releasing member in the standby area when the housings are not yet connected. The releasing member is still in the standby area when the housings are partly connected. However, the releasing member is moved to the releasing position to deform the shorting terminal and to release a shorted state of the terminal fittings when the housings are connected properly. Thus, movement of the releasing member to the releasing position indicates that the two housings have reached a properly connected state.

The releasing member may not move smoothly to the releasing position if the releasing member is displaced relative to the housing or if the releasing member and the housing are brought forcibly into contact. In such a case, an operator may mistakenly conclude that the housings are connected properly despite the partly connected state thereof and may leave the housings only partly connected.

The invention was developed in view of the above problem, and an object thereof is to enable a releasing member to be moved smoothly.

SUMMARY OF THE INVENTION

The invention relates to a connector having a housing that is connectable with a mating housing. A shorting terminal is mounted in the mating housing for shorting terminal fittings therein. A releasing member is provided in the housing and is movable between a releasing position and a standby area located behind the releasing position. The releasing member has a locking piece that engages a resilient piece of the housing to hold the releasing member in the standby area when the housing is not yet connected with the mating housing. The releasing member remains in the standby area when the housing is connected partly with the mating housing. However, the mating housing engages the releasing member in the process of connecting the housings and resiliently deforms the releasing member sufficiently to release the interlocked state of the resilient piece and the locking piece. Accordingly, the releasing member is moved to the releasing position and resiliently deforms the shorting terminal away from the terminal fittings when the housing is connected properly with the mating housing.

The housing preferably has at least one guiding hole and the releasing member is guided in the guiding hole in a movable range between the standby area and the releasing position. Thus, the releasing member can be moved smoothly without being forced and without being displaced transversely.

The resilient piece and/or the locking piece preferably can deform resiliently at an angle to their interlocking directions. Thus, at least one of the resilient piece and the locking piece preferably can deform resiliently to release their interlocked state. The resilient piece and the locking piece then can be separated in directions substantially perpendicular to their deforming directions.

The resilient piece and the locking piece conceivably could be made to deform together due to frictional resistance at their interlocked portions when an attempt is made to disengage the resilient piece and the locking piece, and as a result it may not be possible to release the interlocked state. However, the resilient piece and the locking piece of the subject invention separate from each other in the directions at an angle to the deforming directions of the resilient piece and the locking piece. Therefore, there is no likelihood that the resilient piece and the locking piece are resiliently deformed together.

The guiding hole preferably is substantially flat and has a larger transverse dimension and a smaller vertical dimension.

The releasing member preferably is substantially flush with the rear surface of the housing when the releasing member is in the releasing position.

The resilient piece preferably is deformed resiliently and at least one disengaging portion of the housing is fit into at least one locking recess of the mating housing when the housings are connected properly.

The resilient piece preferably contacts the mating housing and is stopped at its front end position to restrict approaching movement of the housing toward the mating housing when the housings are connected properly.

The locking piece receives pressing forces at angle to the moving directions of the releasing member as the resilient piece is deformed. Thus, the locking piece is deformed resiliently in and the releasing member is moved back relative to the housing.

First and second locks preferably are displaced obliquely in and back relative to the resilient piece as the locking piece is deformed relative to a restricting portion at the base end of the resilient piece, thereby releasing the engaged state of the lock and the resilient piece.

The invention also relates to a connector assembly comprising the above-described connector and a mating connector.

These and other features of the invention will be more apparent upon reading the following detailed description and accompanying drawings. It should be understood that even though embodiments are described separately, single features thereof may be combined to additional embodiments.

DETAILED DESCRIPTION OF THE PREFERRED EMBODIMENTS

Figure 1:
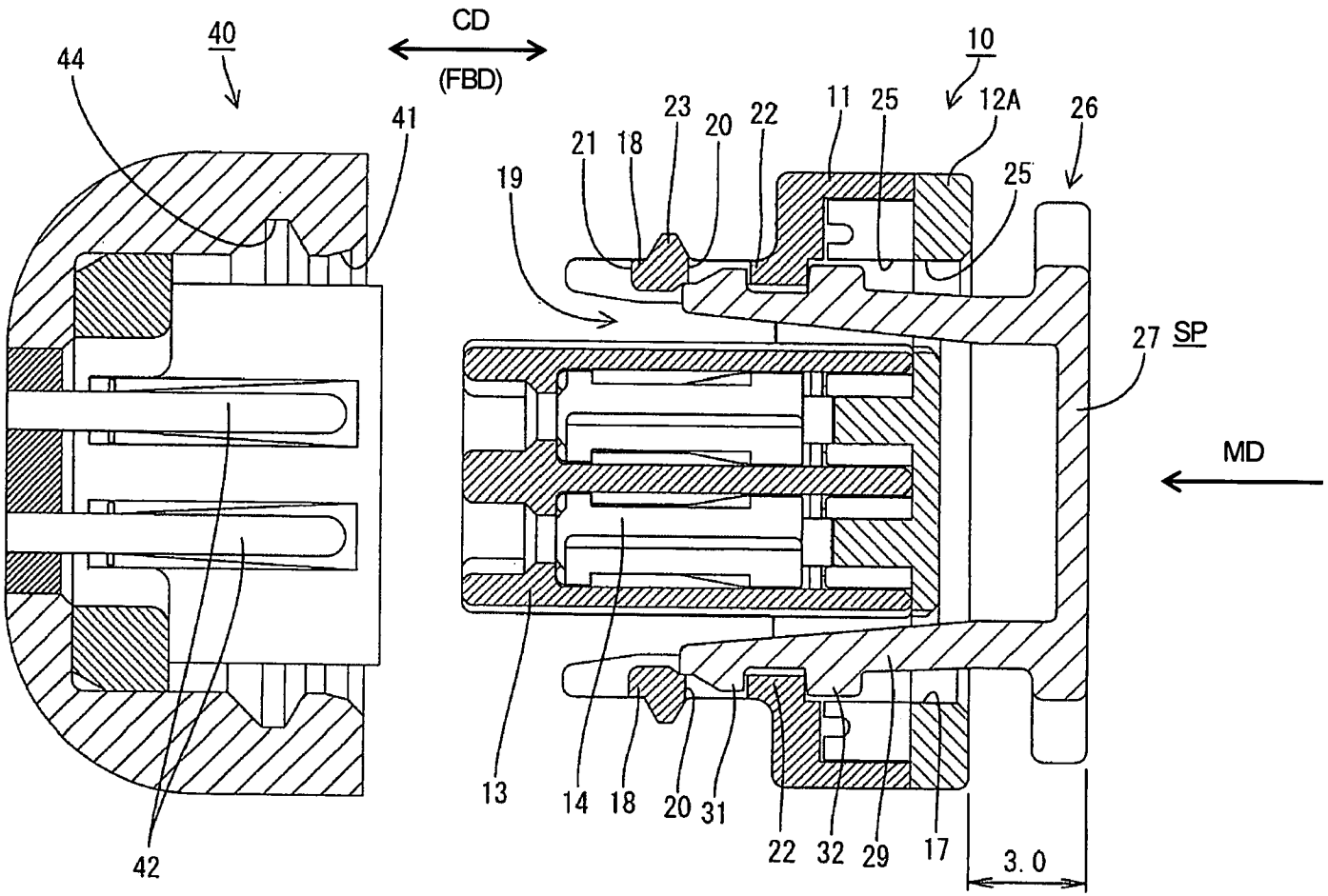
FIG. 1 is a horizontal section showing a state before a first and second housings are connected in one embodiment of the invention.

A connector assembly in accordance with the invention includes first and second housings that are identified respectively by the numerals 10 and 40 in FIGS. 1 to 13. Mating ends of the first and second housings 10, 40 are referred to herein as the front.

The first housing 10 includes a main body 11 made of a synthetic resin and upper and lower covers 12A and 12B that are mounted on the main body 11. A connecting projection 13 projects forward from the upper end of the main body 11, and female terminal fittings 14 are accommodated in the connecting projection 13 from behind. Wire connecting portions 15 extend down from rear ends of the female terminal fittings 14 are connected with wires 16. The female terminal fittings 14 are covered by the upper and lower covers 12A, 12B mounted on the rear surface of the main body 11. An accommodating recess 17 is formed in the rear of the upper cover 12A.

Left and right resilient pieces 18 cantilever forward from upper positions on the main body 11 at opposite left and right sides of the connecting projection 13 and deformation spaces 19 are defined between the resilient pieces 18 and the connecting projection 13. The resilient pieces 18 are resiliently deformable in transverse directions towards and away from the connecting projection 13 and substantially normal to a connecting direction CD of the two housings 10, 40 with the rear ends of the resilient pieces 18 as supports. A window 20 penetrates each resilient piece 18 at a position near the supporting point of resilient deformation and a notch 21 is formed in the front end of each resilient piece 18 before the window 20. A restricting portion 22 is formed on each resilient piece 18 behind the window 20 and a disengaging portion 23 projects out from the outer side of the resilient piece 18 at a position between the window 20 and the notch 21.

Left and right guiding holes 24 penetrate the main body 11 and the upper cover 12A of the first housing 10 in forward and backward directions FBD. The guiding holes 24 are substantially flat and have a larger transverse dimension than a vertical dimension. The guiding holes 24 of the cover 12 communicate with the accommodating recess 17, and the lower peripheral edges of the guiding holes 24 of the main body 11 are substantially flush and continuous with the upper surface of the connecting projection 13. Communication holes 25 are formed in the main body 11 and the cover 12A and extend down from ends of the respective guiding holes 24. The communication holes 25 communicate with the deformation spaces 19 between the connecting projection 13 and the resilient pieces 18 and also communicate with the accommodating recess 17.

The first housing 10 has a releasing member 26 made e.g. of a synthetic resin. The releasing member 26 has a plate-shaped pressing portion 27 to be accommodated in the accommodating recess 17. Left and right substantially flat unlocking pieces 28 are cantilevered forward from upper-end positions of the pressing portion 27, and left and right locking pieces 29 are cantilevered forward from the left and right edges of the pressing portion 27. The unlocking pieces 28 are inserted into the guiding holes 24 from behind, and are held in sliding contact with inner surfaces of the guiding holes 24 to prevent vertical and transverse displacements of the unlocking pieces 28. Further, the locking pieces 29 are inserted into the communication holes 25 from behind, and the front ends of the locking pieces 29 are in the deformation spaces 19. A first lock 31 projects laterally out from the front end of each locking piece 29. The first lock 31 has a slanted surface 31*a* inclined with respect to moving directions MD of the releasing member 26 relative to the housing 10. Further, a second lock 32 projects laterally out at a position on the locking piece 29 behind the first lock 31.

A releasing member 26 is movable forward and back relative to the first housing 10 along a moving direction MD that is substantially parallel with the connecting direction CD of the two housings 10, 40. A releasing position RP is defined at the front of the movable range and a standby area is defined in the movable range behind the releasing position RP. The releasing member 26 is held at a standby position SP in the standby area before the first housing 10 is connected with the second housing 40.

The second housing 40 is made e.g. of a synthetic resin and a connecting recess 41 extends into the front surface of the second housing 40. Long narrow left and right male terminal fittings 42 project forward in the connecting recess 41. A shorting terminal 43 is provided in the connecting recess 41 above the male terminal fittings 42 for shorting the male terminal fittings 42. The shorting terminal 43 is held resiliently in contact with both male terminal fittings 42 when the first and second housings 10, 40 are not connected or partly connected, thereby holding both male terminal fittings 42 shorted and electrically connected. Further, locking recesses 44 are formed in the lateral inner wall surfaces of the connecting recess 41.

Figure 2:
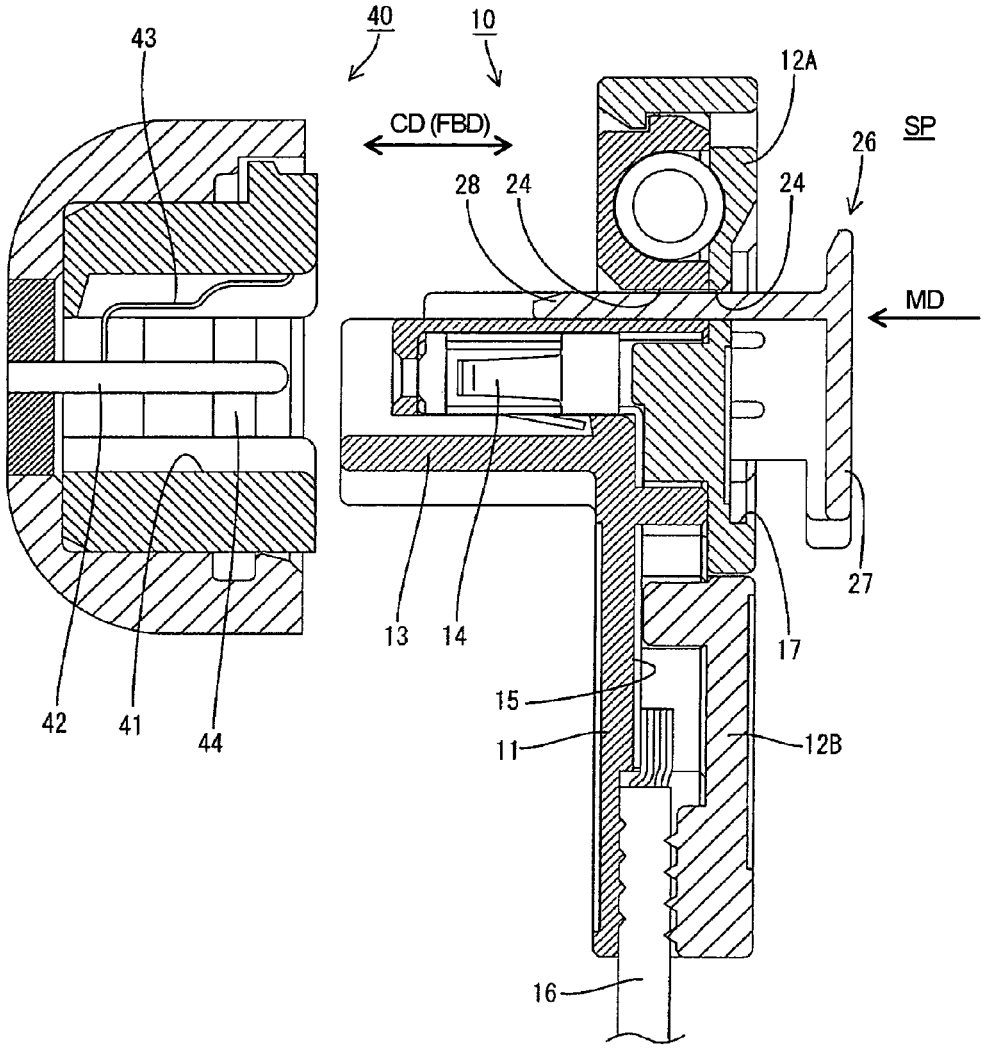
FIG. 2 is a vertical section showing the state before the housings are connected.

The releasing member 26 is mounted at the standby position SP in the first housing 10, as shown in FIG. 1. In this state, the unlocking pieces 28 are in the guiding holes 24, as shown in FIG. 2, to prevent the releasing member 26 from moving vertically and transversely relative to the first housing 10 in directions substantially normal to a moving direction MD of the releasing member 26. The first and second locks 31, 32 are engaged respectively with the restricting portions 22 from the front and rear, respectively. Thus, the releasing member 26 is prevented from moving forward and back parallel with the moving directions MD of the releasing member 26 through the guiding holes 24 and parallel with the connecting direction CD of the housings 10, 40. At this time, the first locks 31 are in the windows 20. Further, the pressing portion 27 is outside the accommodating recess 17 and behind the cover 12, and a distance between the rear surface of the releasing member 26 (pressing portion 27) and the rear surface of the first housing 10 (cover 12) is e.g. about 3.0 mm.

Figure 3:
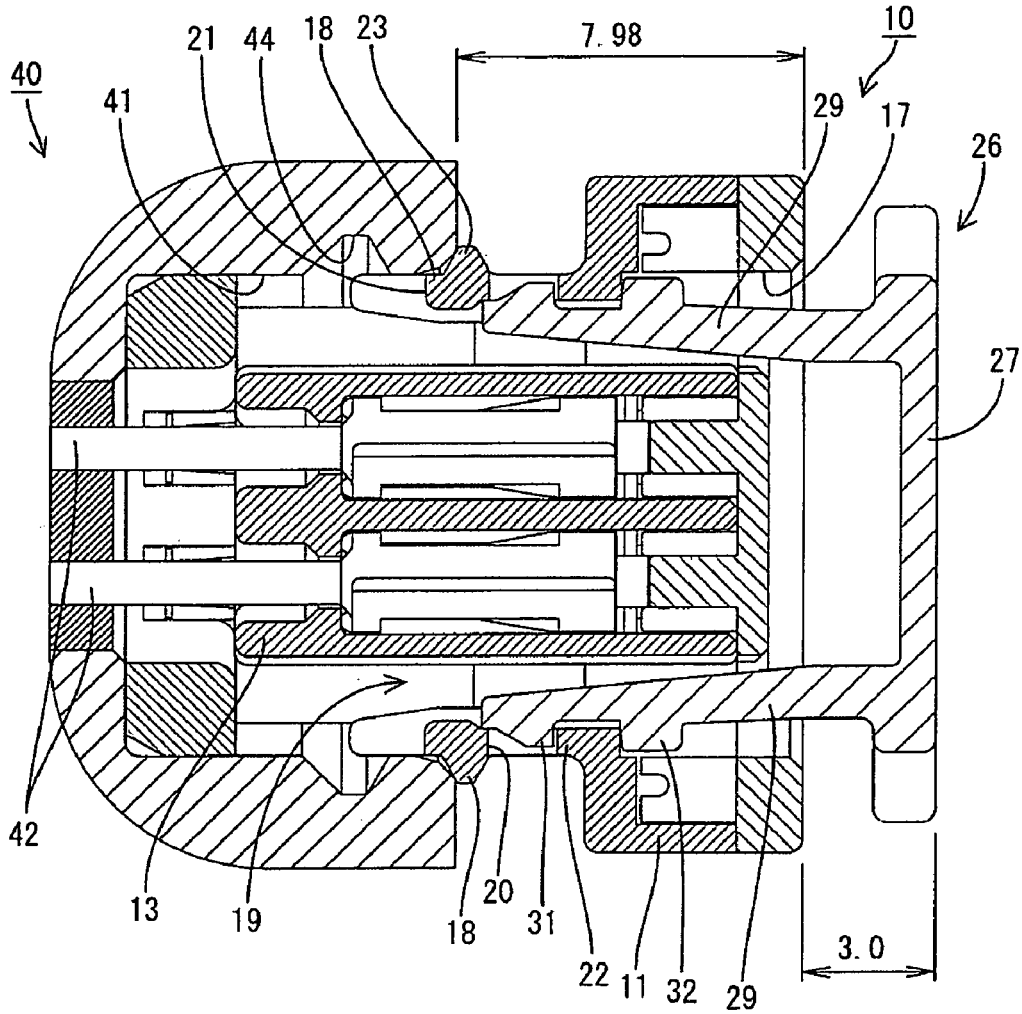
FIG. 3 is a horizontal section showing a state at the start of a connecting operation of the first and second housings.

The first housing 10 is brought closer to the second housing 40 in the connecting direction CD so that the connecting projection 13 fits lightly into the connecting recess 41. Also, the disengaging portions 23 of the resilient pieces 18 contact the opening edges of the connecting recess 41, as shown in FIG. 3. At this time, a distance between the rear surface of the first housing 10 and the front surface of the second housing 40 is e.g. about 7.98 mm.

Figure 4:
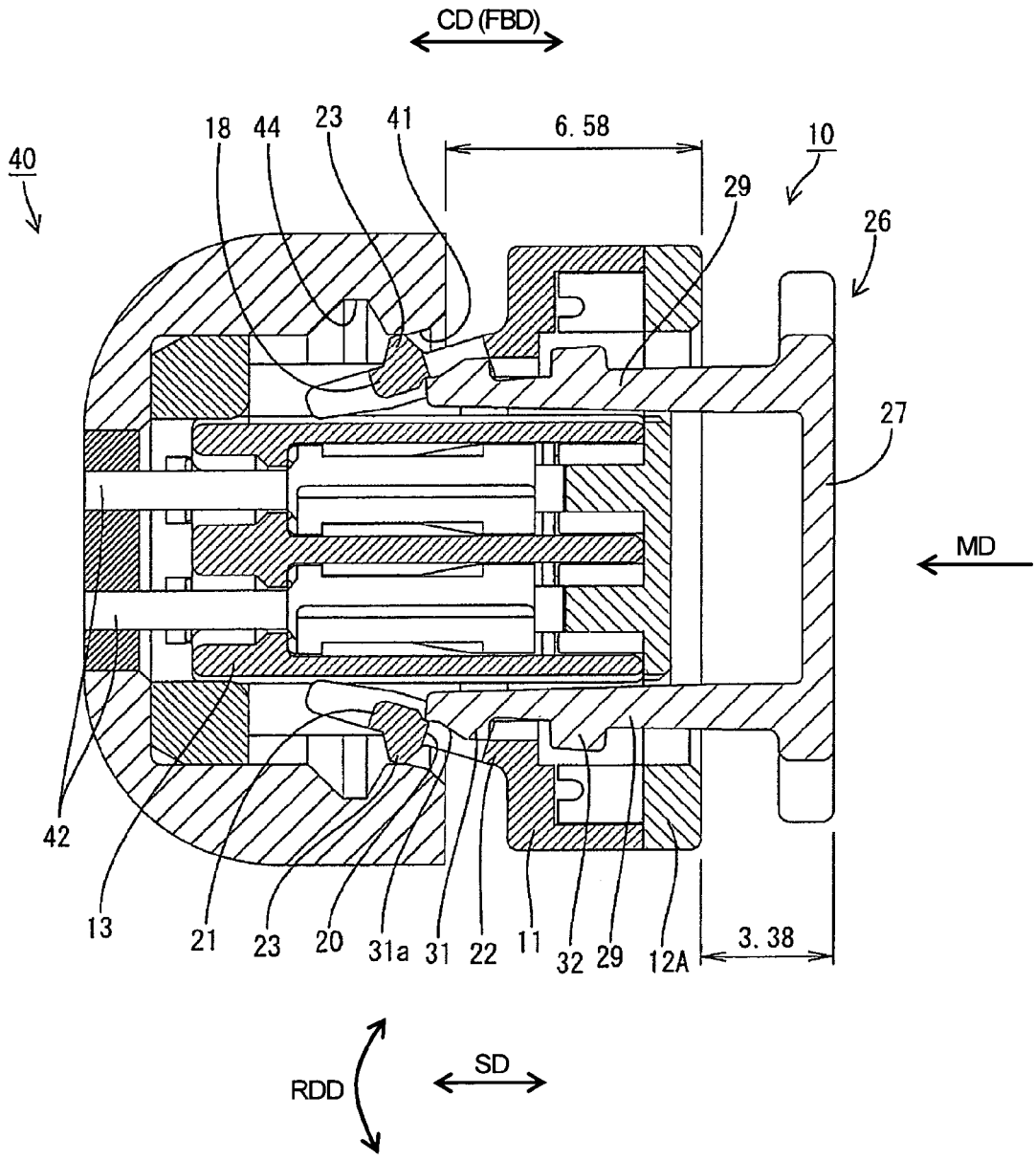
FIG. 4 is a horizontal section showing a process of connecting the first and second housings.

Fingers can be placed on the rear surface of the pressing portion 27 of the releasing member 26 in this state to push the first housing 10 towards the second housing 40. However, inner walls of the connecting recess 41 interfere with the disengaging portions 23 and deform the resilient pieces 18 inwardly, as shown in FIG. 4. As a result, the disengaging portions 23 press the first locks 31 obliquely back from the outer sides. The locking pieces 29 receive these pressing forces obliquely from outer front sides. Thus, the locking pieces 29 deform in and move back relative to the first housing 10. As a result, the first and second locks 31, 32 displace obliquely in and to the back relative to the restricting portions 22 at the base ends of the resilient pieces 18, and the locks 31, 32 disengage from the restricting portions 22. The releasing member 26 then can be moved forward relative to the first housing 10. A distance between the rear surface of the first housing 10 and the front surface of the second housing 40 is e.g. about 6.58 mm, and a distance between the rear surface of the releasing member 26 and the rear surface of the first housing 10 is e.g. about 3.38 mm. At this time, the releasing member 26 is in the standby area.

Figure 5:
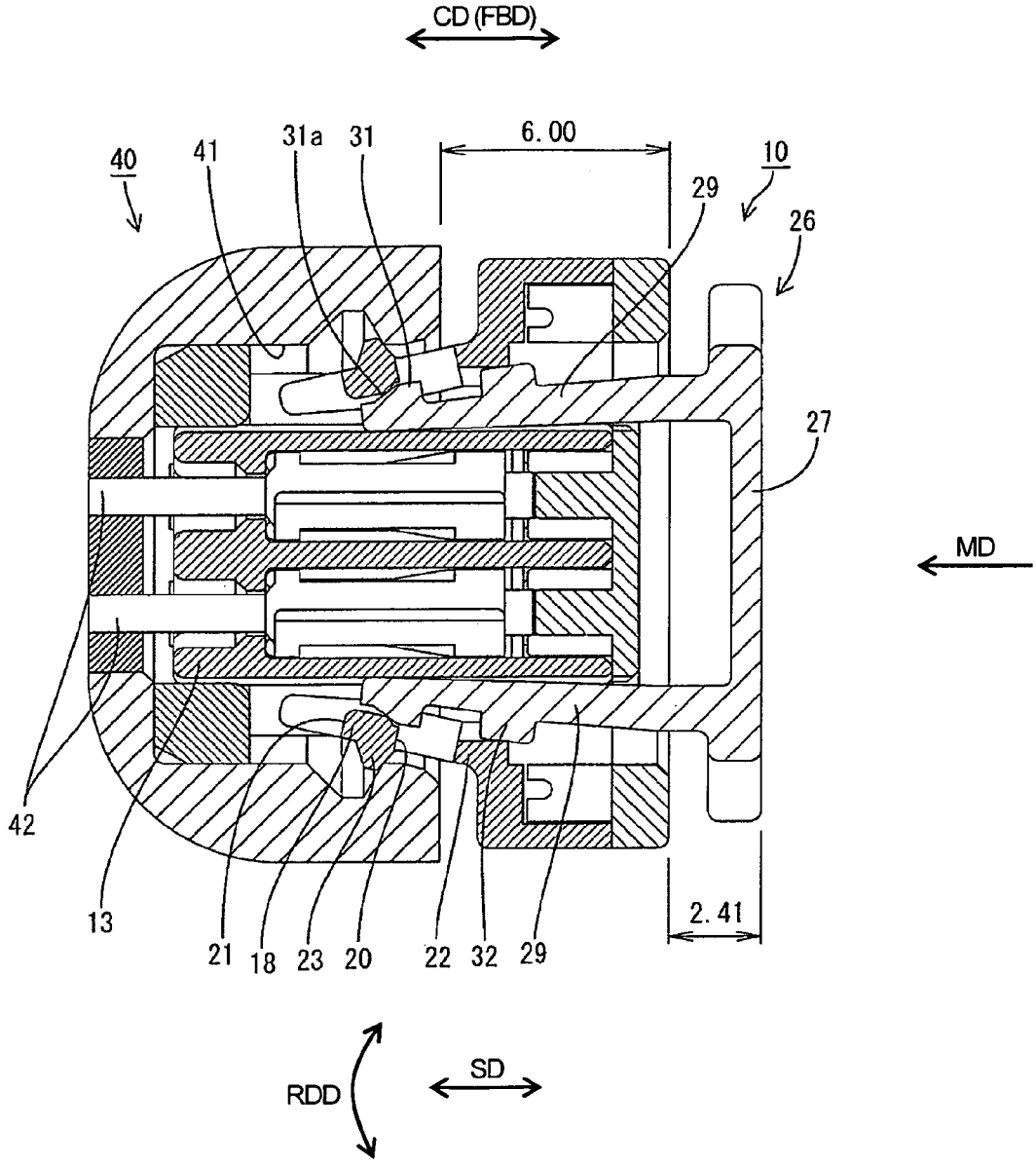
FIG. 5 is a horizontal section showing the process of connecting the first and second housings.

The first housing 10 and the releasing member 26 can be pushed further in this state along the connecting direction CD. Thus, the releasing member 26 is displaced forward relative to the first housing 10 and the locking pieces 29 deform further inwardly. As a result, the slanted surfaces 31*a* push the disengaging portions 23 forward, as shown in FIG. 5, so that the first housing 10 and the releasing member 26 approach the second housing 40. Even at this point, the releasing member 26 still is in the standby area. In a state shown in FIG. 5, a distance between the rear surface of the releasing member 26 and the rear surface of the first housing 10 is e.g. about 2.41 mm.

Figure 6:
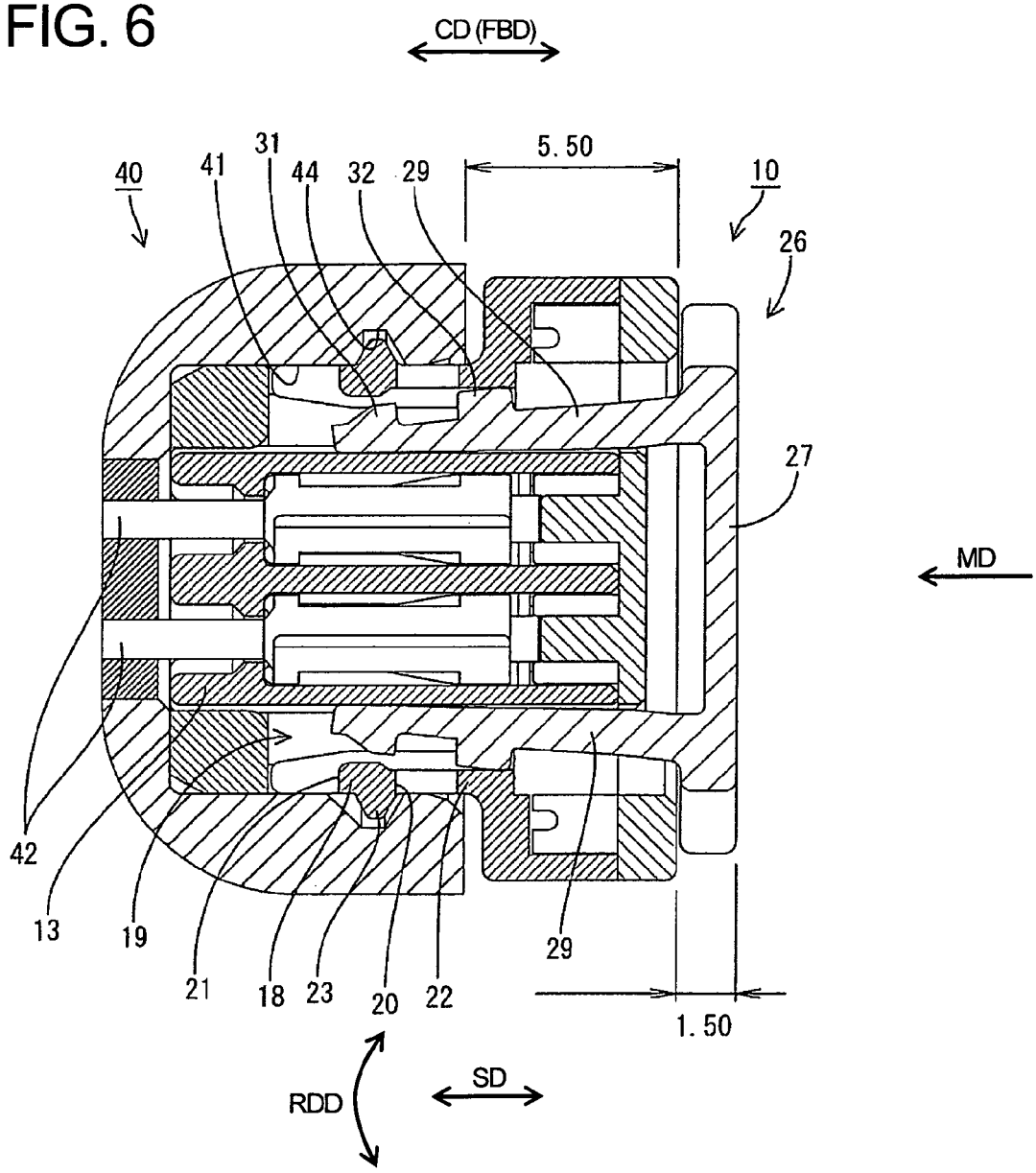
FIG. 6 is a horizontal section showing a state where the first and second housings are properly connected.

The resilient pieces 18 are deformed resiliently out when the two housings 10, 40 reach a properly connected state and the disengaging portions 23 are fit into the locking recess 44, as shown in FIG. 6. Thus, the front ends of the resilient pieces 18 contact the back surface of the fitting recess 41 and stop at their front positions to restrict approaching movements of the first and second housings 10, 40. At this time, a distance between the rear surface of the first housing 10 and the front surface of the second housing 40 is e.g. about 5.50 mm and a distance between the rear surface of the releasing member 26 and that of the first housing 10 is e.g. about 1.50 mm.

Figure 7:
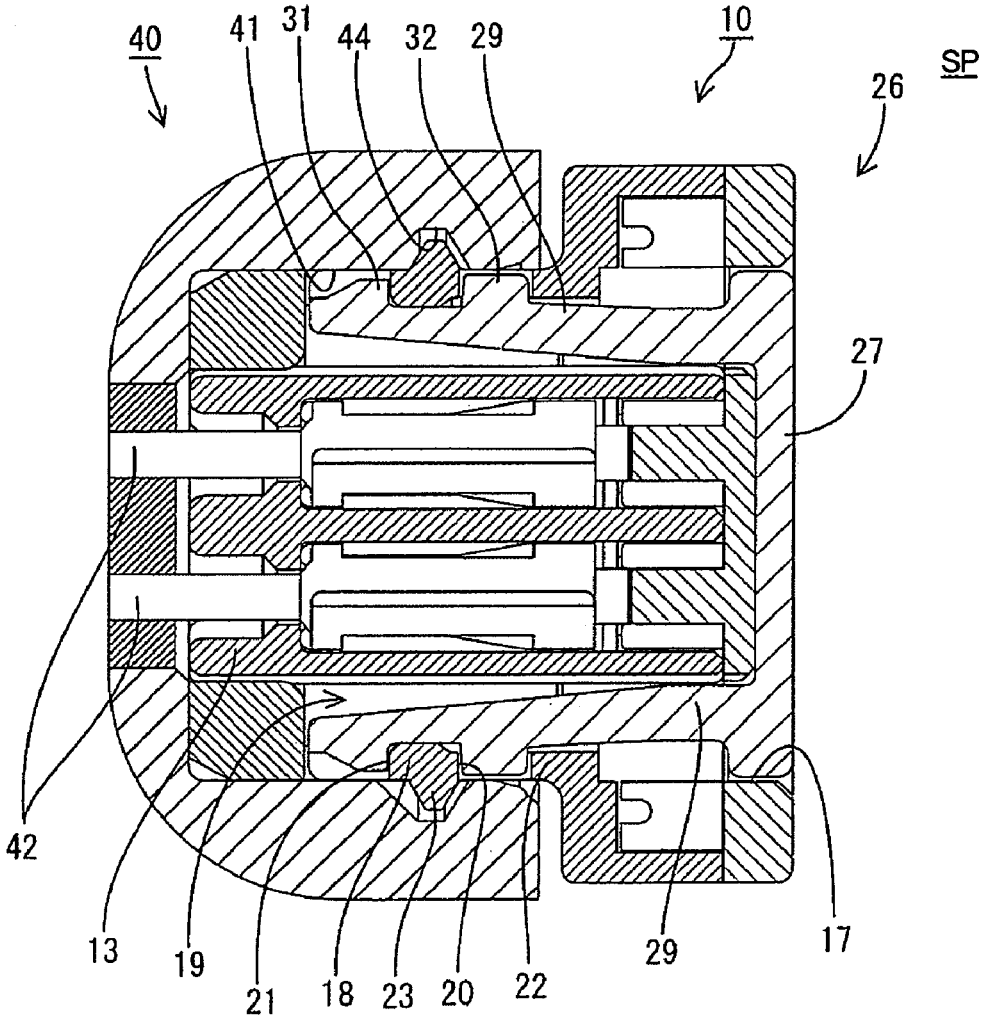
FIG. 7 is a horizontal section showing the first and second housings properly connected and a shorted state of male terminal fittings is released.
Figure 8:
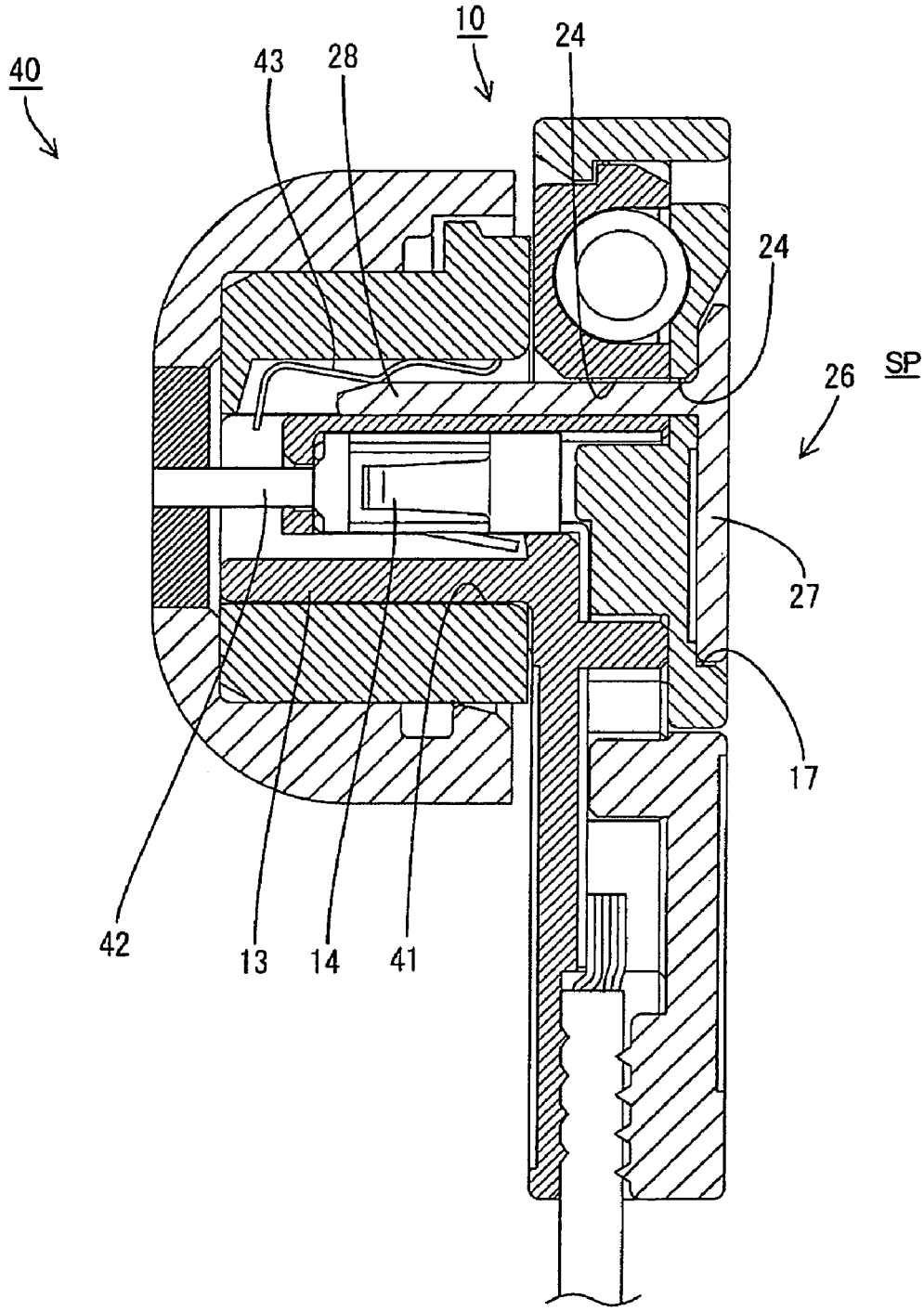
FIG. 8 is a vertical section showing the housings properly connected and the shorted state of the male terminal fittings released.
Figure 9:
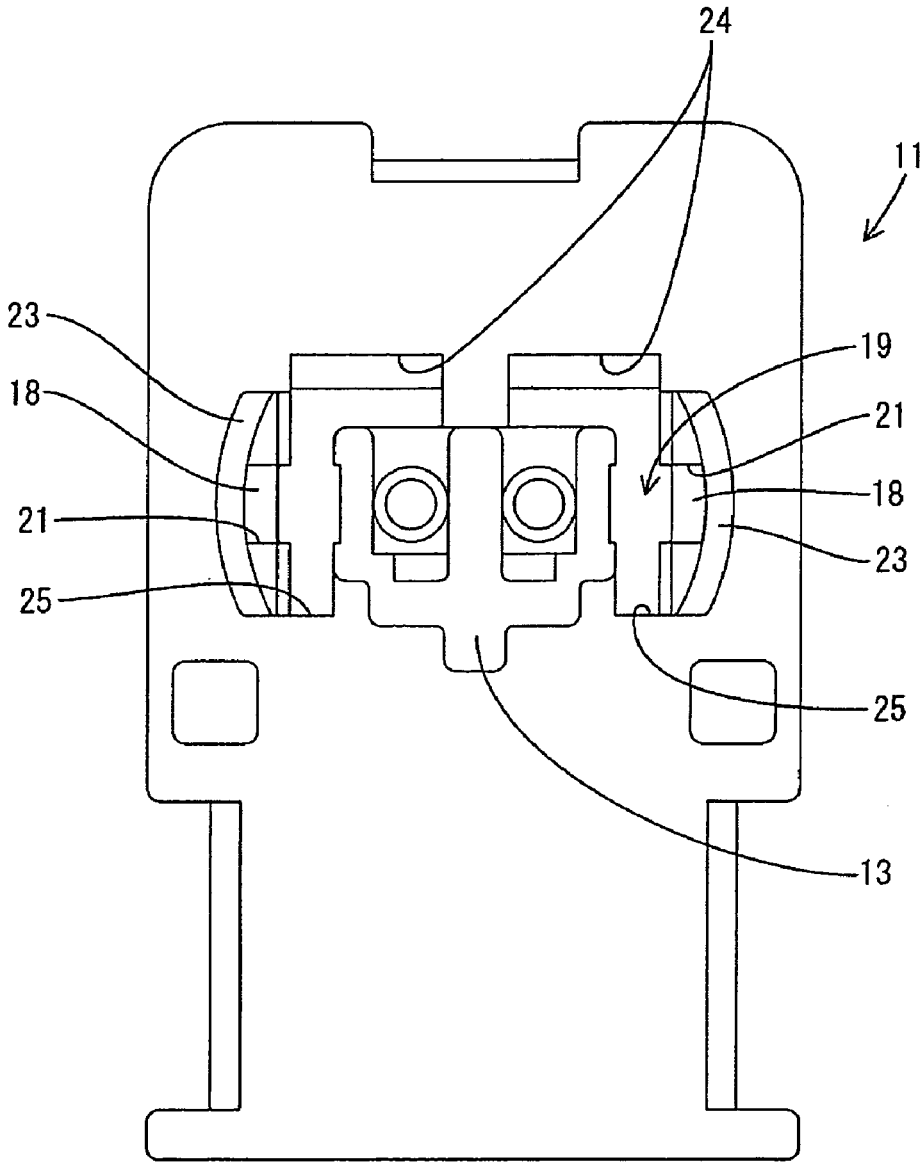
FIG. 9 is a front view of a main body of the first housing.
Figure 10:
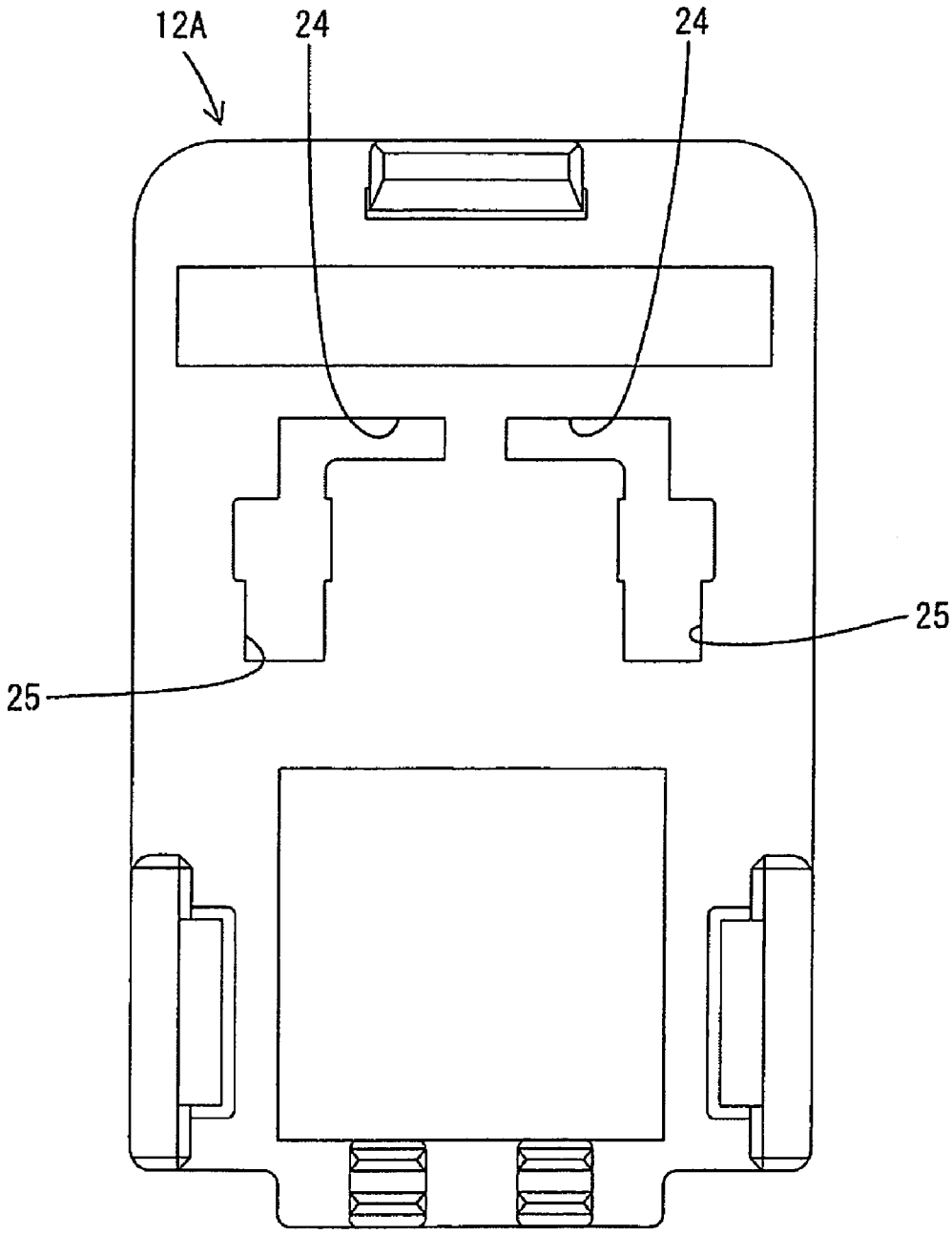
FIG. 10 is a rear view of a cover of the first housing.
Figure 11:
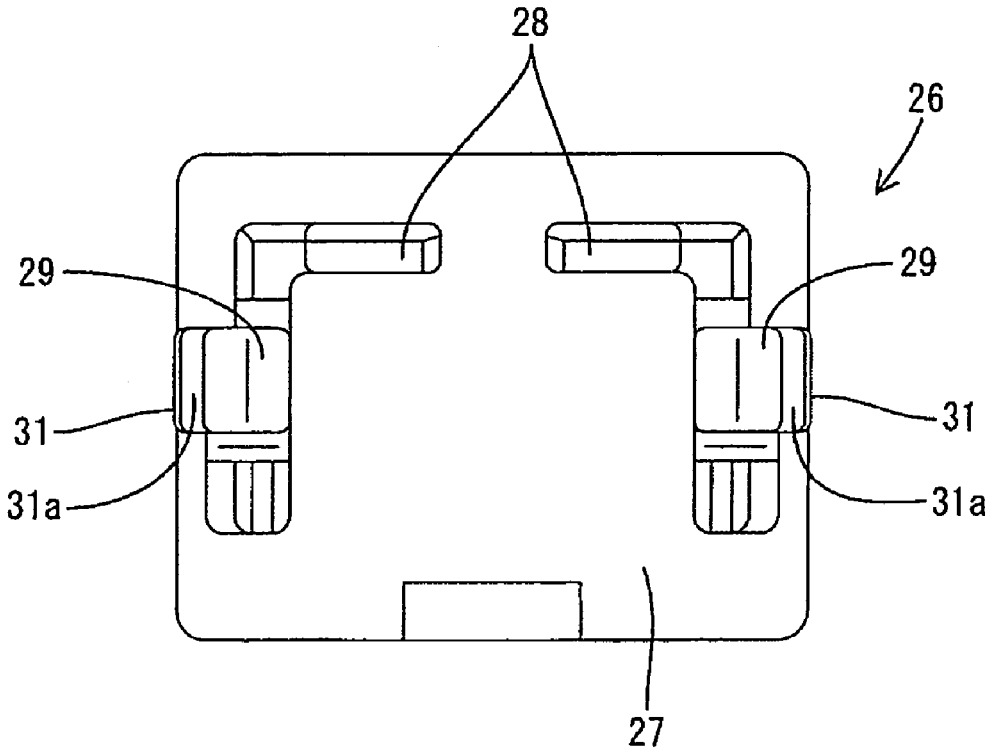
FIG. 11 is a front view of the releasing member.
Figure 12:
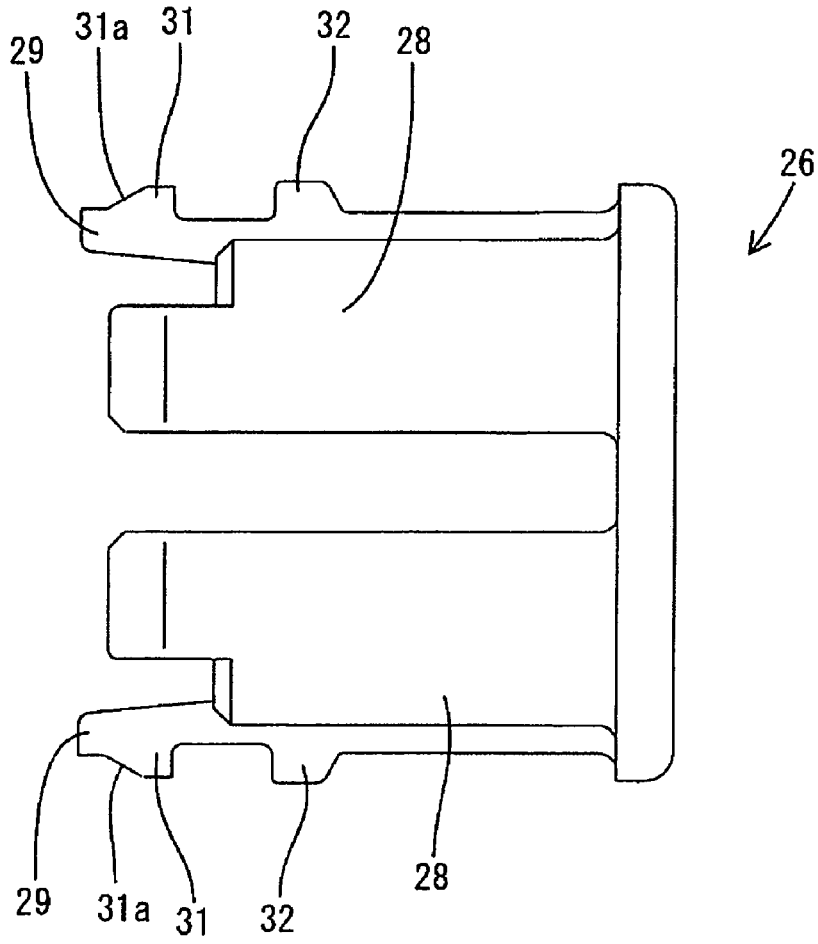
FIG. 12 is a plan view of the releasing member.
Figure 13:
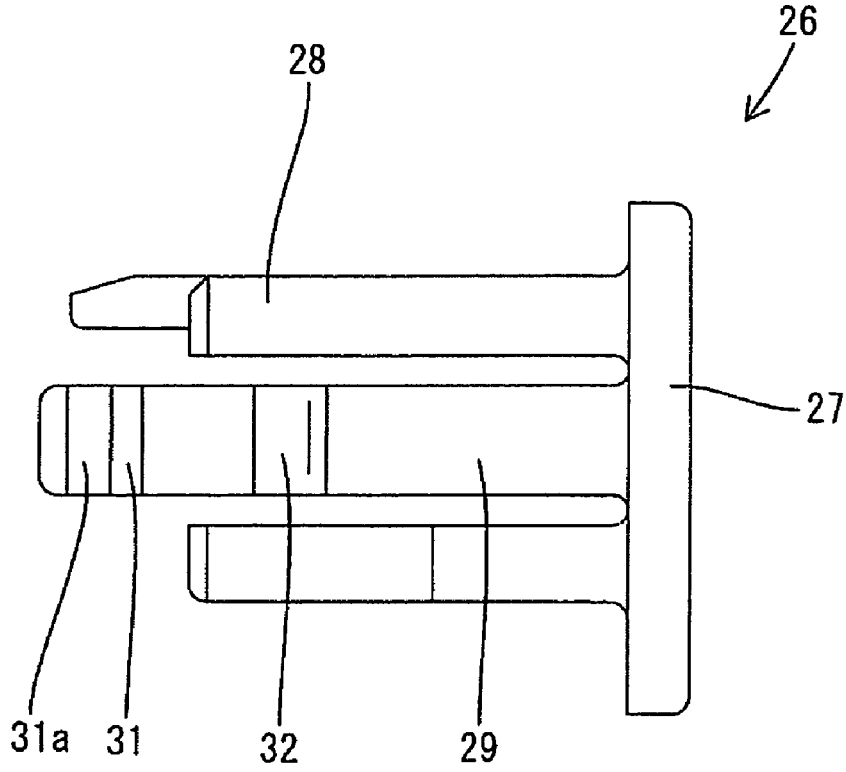
FIG. 13 is a side view of the releasing member.

The rear surface of the releasing member 26 can be pushed in this state. As a result, the releasing member 26 approaches the second housing 40 and moves forward relative to the first housing 10. The locking pieces 29 deform resiliently out when the releasing member 26 reaches the releasing position RP. Thus, the first locks 31 are fit into the notches 21, and the second locks 32 are fit into the windows 20, as shown in FIG. 7. As a result, the first and second locks 31, 32 engage the disengaging portions 23 from front and rear to prevent the releasing member 26 from being moved in forward and backward directions FBD relative to the first housing 10. Further, the pressing portion 27 of the releasing member 26 is accommodated in the accommodating recess 17, and the rear surface of the releasing member 26 becomes substantially flush with the rear surface of the first housing 10. The unlocking pieces 28 resiliently deform the shorting terminal 43 up and away from the male terminal fittings 42, as shown in FIG. 8, when the releasing member 26 reaches the releasing position RP, and the shorted state of the left and right terminal fittings 42 is released by the resilient deformation of the shorting terminal 43.

As described above, the releasing member 26 is provided in the first housing 10 for movement between the releasing position RP and the standby area located behind the releasing position RP, and the shorting terminal 43 for shorting the male terminal fittings 42 is provided in the second housing 40. The resilient pieces 18 in the first housing 10 engage the locking pieces 29 on the releasing member 26 to hold the releasing member 26 in the standby area. The releasing member 26 is still in the standby area when the first and second housings 10, 40 are partly connected. However, the releasing member 26 is moved to the releasing position RP to deform the shorting terminal 43 and to release the shorted state of the male terminal fittings 42 when the first and second housings 10, 40 are connected properly.

The first housing 10 is formed with the guiding holes 24 and the releasing member 26 is slid in the guiding holes 24 in the movable range between the standby area and the releasing position RP. The resilient pieces 18 engage the second housing 40 and resiliently deform in the process of connecting the first and second housings 10, 40 while the locking pieces 29 and the second housing 40 are not in contact. Thus, the interlocked state of the resilient pieces 18 and the locking pieces 29 is released. The releasing member 26 is guided by the guiding holes 24 in the first housing 10 and hence is moved smoothly without being displaced or being forced.

The resilient pieces 18 and the locking pieces 29 could be resiliently deformable in resilient deformation directions RDD that are perpendicular to their interlocking directions for disengagement from each other. However, in such a connector, the resilient pieces 18 and the locking pieces 29 are deformed together due to frictional resistance at interlocked portions of these pieces 18, 29 when an attempt is made to disengage the resilient pieces 18 and the locking pieces 29. As a result, it may not be possible to release the interlocked state.

However, in the subject invention, the resilient pieces 18 and the locking pieces 29 separate in the separating directions SD substantially perpendicular to the deforming directions RDD thereof upon disengaging the resilient pieces 18 and the locking pieces 29. Therefore, there is no likelihood that the resilient pieces 18 and the locking pieces 29 are resiliently deformed together.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Both the resilient pieces and the locking pieces deform and disengage from each other in the foregoing embodiment. However, only the resilient pieces or the locking pieces may deform upon disengaging the resilient pieces and the locking pieces from each other according to the invention.

The resilient pieces and the locking pieces separate in directions substantially perpendicular to the deforming directions thereof upon being disengaged from each other in the foregoing embodiment. However, they may not separate in directions substantially perpendicular to the deforming directions thereof upon being disengaged from each other according to the invention.

What is claimed is:

1. A connector, comprising:

a housing connectable with a mating housing that has a shorting terminal for shorting terminal fittings, the housing having at least one resilient piece, a releasing member mounted to the housing for movement between a releasing position and a standby area behind the releasing position, a locking piece formed on the releasing member, the locking piece engaging the housing and holding the releasing member in the standby area on the housing when the housing is not yet connected with the mating housing, the releasing member being configured to resiliently deform in the process of connecting the housing with the mating housing while the locking piece is spaced from the mating housing so that an interlocked state of the resilient piece and the locking piece is released, the releasing member being moved to the releasing position when the housing is connected properly with the mating housing to resiliently deform the shorting terminal and to release a shorted state of the terminal fittings.

2. The connector of claim 1, wherein the housing includes at least one guiding hole, the releasing member being inserted through and guided by the guiding hole in a movable range between the standby area and the releasing position.

3. The connector of claim 2, wherein the guiding hole has a substantially flat wide cross-section.

4. The connector of claim 1, wherein the resilient piece and the locking piece are resiliently deformable in directions at an angle to interlocking directions of the resilient piece and the locking piece.

5. The connector of claim 4, wherein at least one of the resilient piece and the locking piece is deformed resiliently to release the interlocked state of the resilient piece and the locking piece.

6. The connector of claim 1, wherein the resilient piece and the locking piece are disengaged from each other while separating in the directions substantially perpendicular to deforming directions of at least one of the resilient piece and the locking piece.

7. The connector of claim 1, wherein a rear surface of the releasing member is substantially flush with the corresponding surface of the housing when the releasing member is in the releasing position.

8. The connector of claim 1, wherein the resilient piece is resiliently deformed when the housing is connected properly with the mating housing, while at least one disengaging portion of the housing is fit into a locking recess of the mating housing.

9. The connector of claim 1, wherein the resilient piece contacts the housing when the housing is connected properly with the mating housing to restrict approaching movement of the housings.

10. The connector of claim 1, wherein the locking piece receives pressing forces from directions substantially perpendicular to the connecting directions of the housing with the mating housing as the resilient piece is deformed substantially inward, and deforms resiliently in while being moved backward relative to the housing.

11. The connector of claim 1, wherein as the locking piece is resiliently deformed, first and second locks are displaced obliquely in and to the back relative to a restricting portion at a base end of the resilient piece, thereby releasing the engaged state of the locking portion and the restricting portion.

12. A connector assembly, comprising:

a first housing having at least one resilient piece;

a second housing having a connecting recess configured for receiving the first housing and for deflecting the resilient piece as the first housing is inserted into the connecting recess, terminal fittings mounted in the second housing and projecting into the connecting recess, a shorting terminal for shorting the terminal fittings;

a releasing member mounted to the first housing for movement between a releasing position and a standby area behind the releasing position, a locking piece formed on the releasing member, the locking piece engaging the first housing and holding the releasing member in the standby area on the first housing when the first housing is not yet connected with the second housing, the locking piece being configured to be deformed by the resilient piece as the resilient piece is deflected in the process of connecting the first housing with the second housing so that an interlocked state of the resilient piece and the locking piece is released, the releasing member being movable to the releasing position when the first housing is connected properly with the second housing to resiliently deform the shorting terminal and to release a shorted state of the terminal fittings.

13. The connector assembly of claim 12, wherein the second housing has a front end, a locking recess being formed in the connecting recess at a position spaced reward of the front end, the front end of the second housing being dimensioned to deflect the resilient piece as the first housing is being inserted into the connecting recess, the locking recess being disposed and dimensioned to permit the resilient piece to resiliently and engage in the locking recess when the housing is connected properly with the mating housing.

14. The connector assembly of claim 13, wherein the resilient piece has a front end and a notch formed in the front end, the locking piece of the releasing member being engaged in the notch when the releasing member to moved to the releasing position.

15. The connector assembly of claim 14, wherein the first housing includes at least one guiding hole, the releasing member being inserted through and guided by the guiding hole in a movable range between the standby area and the releasing position.

16. A connector assembly, comprising:

a mating housing having a front end, a connecting recess extending into the front end and a locking recess formed in the connecting recess, terminal fittings projecting into the connecting recess, a shorting terminal for shorting the terminal fittings;

a first housing dimensioned for insertion into the connecting recess of the mating housing, at least one resilient piece formed on the first housing and a disengaging piece formed on the resilient piece, the disengaging piece being dimensioned to engage the front end of the mating housing as the first housing is being inserted into the connecting recess for generating inward deflection of the resilient piece, the disengaging piece being engageable in the locking recess when the housings are connected properly; and a releasing member movably mounted on the first housing, a locking piece formed on the releasing member and engaging the first housing to hold the releasing member in a standby area when the first housing is not yet connected with the mating housing, the locking piece being configured to be deformed by the resilient piece as the resilient piece is deflected so that an interlocked state of the locking piece and the first housing is released, the releasing member being movable to a releasing position when the disengaging piece is in the locking recess, the releasing member having a releasing piece for deforming the shorting terminal away from the terminal fittings when the releasing member is in the releasing position.

17. The connector assembly of claim 16, wherein the resilient piece has a front end and a notch formed in the front end, the locking piece of the releasing member being engaged in the notch when the releasing member to moved to the releasing position.

18. The connector assembly of claim 17, wherein the first housing includes at least one guiding hole, the releasing piece being inserted through and guided by the guiding hole in a movable range between the standby area and the releasing position.

* * * * *